US005991425A

United States Patent [19]

Anagnos

[11] Patent Number: 5,991,425

[45] Date of Patent: Nov. 23, 1999

[54] LOW REFLECTION/LOW DIFFRACTION TREATMENT FOR LOUDSPEAKER TRANSDUCER DIAPHRAGM

[75] Inventor: Daniel P. Anagnos, Grandview, N.Y.

[73] Assignees: Sony Corporation, Tokyo, Japan; Sony Electronics, Inc., Park Ridge, N.J.

[21] Appl. No.: 08/766,800

[22] Filed: Dec. 13, 1996

[51] Int. Cl.[6] ..... H04R 25/00

[52] U.S. Cl. ..... 381/423; 381/426; 381/354; 381/182

[58] Field of Search ..... 381/202, 204, 381/158, 182, 186, 24, 188, 205, 332, 333, 335, 353, 354, 423, 424, 426, 432; 181/166, 170, 158, 144, 147

[56] References Cited

U.S. PATENT DOCUMENTS

| | | | |
|---|---|---|---|
| 2,763,333 | 9/1956 | Schumann | 381/204 |
| 3,268,030 | 8/1966 | Magnus | 181/147 |
| 3,967,065 | 6/1976 | Ward | 381/335 |
| 4,163,876 | 8/1979 | Ohnuki | 181/170 |
| 4,296,280 | 10/1981 | Richie | 381/335 |
| 4,478,309 | 10/1984 | Kawamura et al. | 181/166 |
| 4,497,981 | 2/1985 | House | 381/182 |
| 4,569,076 | 2/1986 | Holman | 381/333 |
| 5,448,647 | 9/1995 | Koizumi | 381/24 |
| 5,570,429 | 10/1996 | Paddock | 381/202 |
| 5,608,810 | 3/1997 | Hall | 381/202 |

FOREIGN PATENT DOCUMENTS

| | | | |
|---|---|---|---|
| 2409653 | 7/1979 | France | 381/202 |
| 0045211 | 3/1980 | Japan | 381/202 |

OTHER PUBLICATIONS

TEAC Manual, "The Sierra Series," ST–X5, TEAC Corporation of America, 7733 Telegraph Road, Montebello, CA 90640.

Peerless 1" Dome Tweeter.

Peerless 6 ½" Woofer.

Sony, "Technical Design Concepts and Philosophy of the SS–M9 Loudspeaker," 1994 Sony Electronics Inc.

E.A.R. Technical Data Sheet TDS–09, Division, Cabot Safety Corporation, Delaware Industrial Park, Newark, DE 19713.

*Primary Examiner*—Huyen Le

*Attorney, Agent, or Firm*—Ronald P. Kananen; Rader, Fishman & Grauer

[57] ABSTRACT

An arrangement for minimizing acoustic reflections and diffraction from an exterior surface of a diaphragm of a loudspeaker transducer. A layer of highly optimized acoustic foam is applied to an exterior surface of the transducer diaphragm. The acoustic foam is a polyether urethane material of approximately 2 lb/ft$^3$ density with a skinned bottom surface, optional skinned top surface and optimized cell size and structure. The foam is die cut into a shape to conform to the concave shape of the transducer diaphragm without large air gaps or deformation of the foam. The acoustic foam surface prevents reflection and diffraction of another transducer's output off of the diaphragm of the treated transducer and provides a low pass filtering of the acoustic output of the treated transducer.

15 Claims, 2 Drawing Sheets

LOW REFLECTION/LOW DIFFRACTION TREATMENT FOR LOUDSPEAKER TRANSDUCER DIAPHRAGM

BACKGROUND OF THE INVENTION

1. Field of the Invention

The present invention relates generally to arrangements for reducing acoustic reflections and diffraction in a loudspeaker and, in particular, to an arrangement for minimizing acoustic reflections and diffraction from the exterior surface of a diaphragm of a loudspeaker transducer.

2. Description of the Relevant Art

A common problem in existing loudspeakers is that the acoustic output from a transducer is reflected and diffracted off of the diaphragm of any other transducers in close proximity. The most common situation is the reflection of a tweeter's output off of the midrange or woofer cone (usually directly below or above the tweeter). Complicating the problem is the fact that the midrange or woofer diaphragm is usually conical in shape. This concave cavity causes large phase shifts of the reflected acoustic signals which, when recombined with the primary (on-axis) signal, will result in large amplitude and phase anomalies (the "cavity effect"). The general perception of these anomalies is manifested as large amounts of timbre-related distortion or coloration.

In the past, manufacturers have dealt with this problem by either of two ways: (1) the use of an acoustically absorbing barrier (12 to 25 mm in height) between the transducers; or (2) the use of a flat diaphragm for the midrange or woofer transducers.

The acoustic barrier approach is partially effective, at least at higher frequencies. However, it does not prevent the problem entirely because it can only absorb a portion of the off-axis output from a transducer. This approach may also have a somewhat unpredictable effect upon the loudspeaker's combined off-axis or polar frequency response. Often the acoustic barrier approach is also unacceptable for aesthetic reasons as a result of its protruding height.

On the other hand, the use of a flat diaphragm for the midrange or woofer transducer will eliminate the "cavity effect" mentioned above but does not eliminate reflection and diffraction. The reflections which remain are far less detrimental, but they still exist. In fact, a more severe problem can sometimes be created by using a flat diaphragm—loss of rigidity. Cone-shaped diaphragms are far superior to flat diaphragms in terms of rigidity and freedom from "breakup" or resonant mode excitation.

SUMMARY OF THE INVENTION

It is an object of the present invention to provide a loudspeaker transducer that minimizes acoustic reflections and diffraction from an exterior surface of a diaphragm of the transducer.

It is a further object of the present invention to eliminate the acoustic output from a first loudspeaker transducer from being reflected and diffracted off of the diaphragm of a second loudspeaker transducer in close proximity to the first transducer.

It is a further object of the present invention to provide a loudspeaker transducer treatment that minimizes acoustic reflections and diffraction at selected frequencies, has a predictable effect on the loudspeaker's combined off-axis or polar frequency response, is aesthetically acceptable, eliminates large amplitude and phase anomalies, and does not reduce rigidity in the diaphragm of the transducer.

Additional objects, advantages and novel features of the invention will be set forth in part in the description that follows, and in part will become apparent to those skilled in the art upon examination of the following or may be learned by practice of the invention. The objects and advantages of the invention may be realized and attained by means of the instrumentalities and combinations particularly pointed out in the appended claims.

The present invention provides an arrangement for minimizing acoustic reflections and diffraction from the exterior surface of a diaphragm of a loudspeaker transducer. According to the present invention, a layer of highly optimized acoustic foam is applied to an exterior surface of the transducer diaphragm. The acoustic foam layer provides two effects: (1) it prevents reflection and diffraction of another transducer's output off of the treated transducer's diaphragm; and (2) it provides a low pass filtering of the treated transducer's acoustic output.

In order to achieve the objects set forth above, the present invention comprises a loudspeaker transducer, comprising a diaphragm having an exterior surface, and a layer of optimized acoustical foam attached to the exterior surface for minimizing acoustic reflections and diffraction from the exterior surface and for low pass filtering of an output of the transducer.

The optimized acoustical foam is preferably a polyether urethane material and has a skinned bottom surface and optional skinned top surface. The optimized acoustical foam has a nominal density of approximately 2 $lb/ft^3$, and a thickness in the range of 6.4 mm to 25.4 mm.

In accordance with another aspect of the present invention, the objects set forth above are achieved by a loudspeaker comprising a first transducer having a first operating frequency range, a second transducer having a second operating frequency range and a diaphragm having an exterior surface, and an optimized acoustical foam layer attached to the exterior surface of the second transducer for minimizing acoustic reflections and diffraction off of the diaphragm of the second transducer and for low pass filtering of an output of the second transducer.

The acoustical foam layer preferably provides a means for absorbing all frequencies within the first operating frequency range, which is higher than the second operating frequency range. In a preferred embodiment, the first transducer is a tweeter, and the second transducer is a midrange, woofer, or subwoofer.

BRIEF DESCRIPTION OF THE DRAWINGS

The various features and advantages of the present invention will become more clearly appreciated as a description of the invention is made with reference to the appended drawings. In the drawings.

DETAILED DESCRIPTION OF THE INVENTION

Preferred embodiments of the present invention will be described below by making reference to FIGS. 1 and 2 of the drawings.

Figure 1:
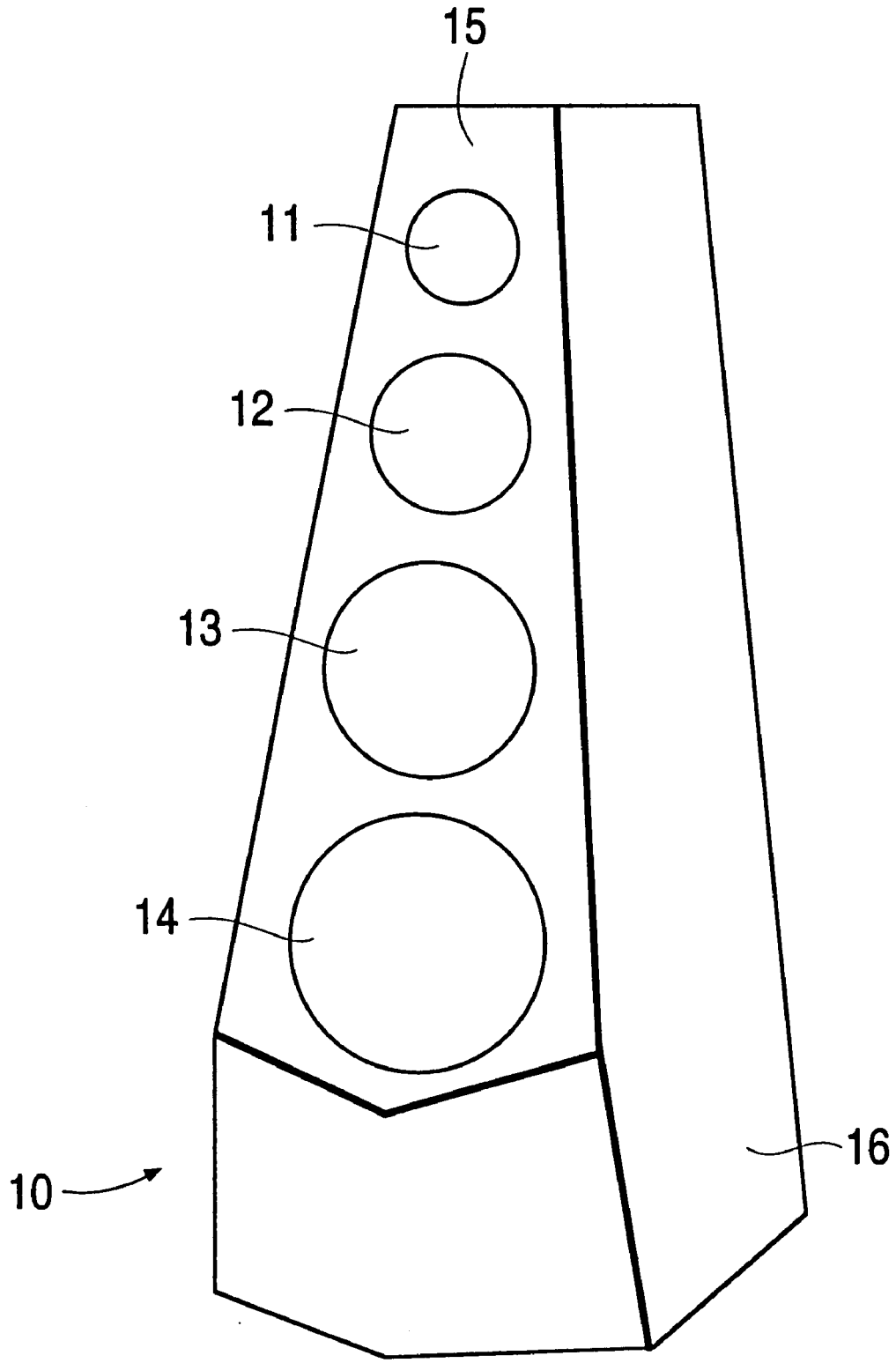
FIG. 1 is a perspective view of a loudspeaker equipped with a transducer having a foam covered diaphragm according to the present invention.
Figure 2:
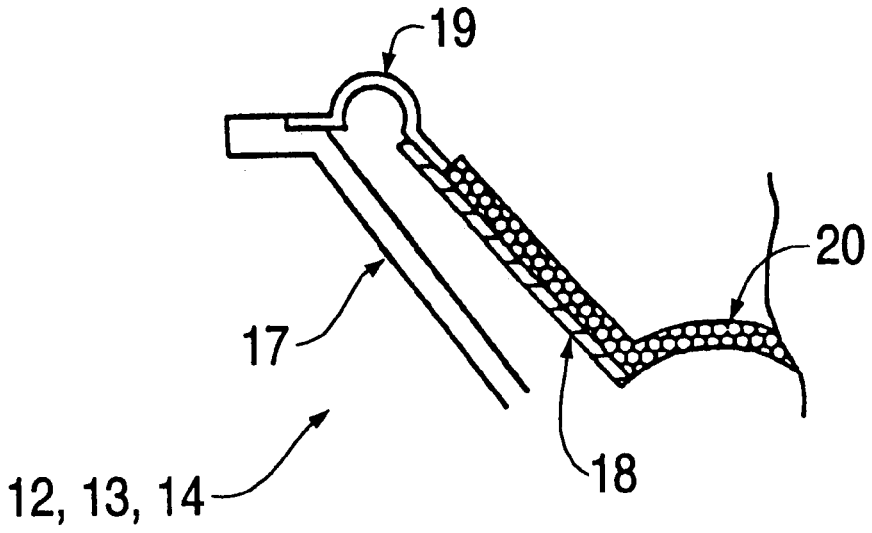
FIG. 2 is a cross section view of a transducer diaphragm covered with a layer of optimized acoustical foam according to the present invention.

The present invention was developed for use in a high performance loudspeaker, such as the loudspeaker 10 shown in FIG. 1. The loudspeaker 10 includes a plurality of speaker transducers 11, 12, 13, 14 (e.g., tweeter, midrange, woofer, and subwoofer, respectively). The speaker transducers are mounted to a baffle board 15 of a speaker cabinet. The speaker cabinet has side walls 16, a rear wall (not shown), and top and bottom walls (not shown) which, together with the baffle board 15, form an airtight enclosure. Various other electrical components (e.g., crossover networks) are mounted within the speaker cabinet.

Each of the loudspeaker transducers 11, 12, 13, 14 comprises a diaphragm that vibrates to generate sound waves. A cross section of the transducers 12, 13, 14 showing a transducer frame 17 and a diaphragm 18 is shown in FIG. 2. A surround member 19 connects an outer periphery of the diaphragm 18 to the transducer frame 17 in a known manner.

By attaching an optimized acoustical foam layer 20 to the exterior surface of the diaphragm 18 of the middle or low frequency transducers 12, 13, 14, reflection and diffraction off of the surface of the diaphragm 18 will be eliminated within a specified frequency range. The acoustical foam layer 20 is optimized in terms of composition and thickness to absorb all frequencies within the bandwidth of the higher frequency range transducer 11. Most of the absorption occurs at frequencies above the desired operating bandwidth of the middle or lower frequency transducers 12, 13, 14. This constitutes an acoustic low pass filtering function of the lower frequency range transducers 12, 13, 14, which is desirable in many loudspeaker arrangements.

There are several provisos which should be adhered to in order to prevent the creation of additional acoustical problems by use of the acoustical foam layer. First, the treated diaphragm material 18 (of the middle or low frequency range transducers 12, 13, 14) must be extremely rigid and capable of handling the additional mass of the foam layer 20 without breaking up (exacerbating resonant modes). For example, a Kevlar™/Nomex™ honeycomb composite and some metal diaphragms will work without complication.

Second, the design of the magnetic motor system of the treated transducer 12, 13, 14 must also account for the additional mass of the foam layer 20. For example, the Thiele/Small parameters of the transducer 12, 13, 14 will be greatly affected by the additional mass of the foam layer 20 and must be accounted for.

Third, the absorption bandwidth of the acoustical foam layer 20 must not over-attenuate the output of the treated transducer 12, 13, 14 (i.e., reduce its operating bandwidth). Careful selection of the composition and thickness of the foam layer 20 will ensure that the intended operating bandwidth of the treated transducer is not reduced.

Figure 3:
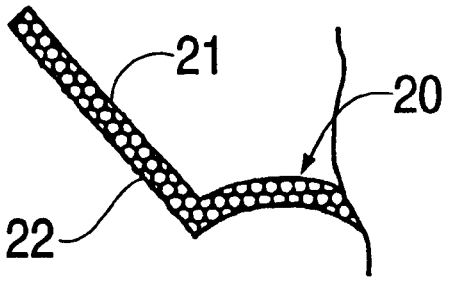
FIG. 3 is a cross section view of an optimized acoustical foam layer having a skinned top and bottom surfaces.

A preferred foam material for acoustic absorption is a polyether urethane material of approximately 2 lb/ft$^3$ density with a skinned bottom surface, 21 and 22, respectively (FIG. 3), and optional skinned top surface and optimized cell size and structure. The thickness of the foam layer 20 will determine how low in frequency the absorption will occur. A minimum thickness of 6.4 mm and a maximum thickness of 25.4 mm is preferred. A foam layer having a 6.4 mm thickness is effective to a frequency of about 1 kHz. The foam layer 20 should conform as closely as possible to the profile of the treated diaphragm 18, without large air gaps.

Suitable foam materials for the foam layer covering the diaphragm are manufactured by E-A-R Specialty Composites, a division of Cabot Safety Corporation, and are sold under the proprietary name TUFCOTE™ Foam Products (Product Nos. E-25SF, E-50SF and E-75SF). The following Table 1 provides a listing of acceptable physical properties for the acoustical foam layer material according to the preferred embodiment.

TABLE 1

PROPERTIES OF THE ACOUSTICAL FOAM LAYER

| PROPERTY | TEST METHOD | PROD. NO. E-25SF | PROD. NO. E-50SF | PROD. NO. E-75SF |
|---|---|---|---|---|
| Thickness | | 0.25 in. (6.4 mm) | 0.50 in. (12.7 mm) | 0.75 in. (19.1 mm) |
| Density Nominal (lb/ft$^3$) | ASTM D3574 | 2.0 | 2.0 | 2.0 |
| Weight Nominal (lb/ft$^2$) | ASTM D3574 | 0.04 | 0.08 | 0.13 |
| Flame | UL 94H | Meets HF-1 | Meets HF-1 | Meets |
| | MVSS 302 | Passes | Passes | HF1 |
| | FAR 25.853(b) | Passes | Passes | Passes |
| | SAE J369(a) | Meets | Meets | Passes |
| Random Incidence Acoustical Absorption Coefficient | ASTM C423-84a and ASTM E795-83 (Mounting A) | | | |
| | | 0.00 | 0.03 | 0.07 |
| | @ 125Hz | 0.03 | 0.13 | 0.18 |
| | @ 250Hz | 0.23 | 0.24 | 0.40 |
| | @ 500Hz | 0.71 | 0.60 | 0.84 |
| | @ 1000Hz | 0.71 | 0.99 | 1.05 |
| | @ 2000Hz | 0.26 | 0.87 | 0.91 |
| | @ 4000Hz | 0.40 | 0.50 | 0.60 |
| | NRC | | | |
| Thermal Resistivity (R) (hr.ft$^2$ °F./BTU) | ASTM C177 (calculated from 1" foam value) | 0.9 | 1.9 | 2.8 |

These foam materials are available with a pressure sensitive adhesive (PSA) backing. However, either PSA or gluing may be used to secure the foam layer to the exterior surface of the diaphragms. The mass of the PSA or glue, as the case may be, must be considered in selecting the optimum weight of foam for acoustic absorption.

The foam layer 20 is preferably die cut (using conventional tooling) into a desired shape, which may be fairly complex to conform to the shape of the diaphragm 18. When attached to the diaphragm 18, the foam layer 20 will conform to the concave (conical) shape of the diaphragm 18 without large air gaps or deformation of the foam layer 20 (particularly if its top surface is skinned). The attachment of the foam layer 20 to the exterior surface of the transducer's diaphragm 18 is preferably a separate subassembly operation performed after receiving the transducer 12, 13, 14 from the producer. Because the optional skinned top surface of the foam layer 20 is very delicate, great care in handling is necessary. After attachment of the foam layer 20 (and adequate curing time if glued), the transducer 12, 13, 14 can be installed in the loudspeaker 10 in a conventional manner.

The inventive concepts of the present invention are applicable to any loudspeaker system employing two or more transducers, regardless of their shape, size or method of operation. An application which has great potential for sonic improvement would be coaxial transducers. Coaxial transducers, in which a high frequency transducer (tweeter) is mounted at the apex of the diaphragm of a larger, lower frequency range transducer (midrange or woofer) usually suffers greatly from the reflection and diffraction effects described earlier. Covering the lower frequency range transducer as described in this disclosure could offer a substantial improvement in performance.

It will be appreciated that the present invention is not limited to the exact construction that has been described above and illustrated in the accompanying drawings, and that various modifications and changes can be made without departing from the scope and spirit thereof. It is intended that the scope of the invention only be limited by the appended claims.

The invention claimed is:

1. A loudspeaker transducer, comprising:

a diaphragm having an exterior surface on a side of the diaphragm facing a listening environment; and a layer of optimized acoustical foam attached to said exterior surface which is so constructed as to absorb external acoustic energy and minimize acoustic reflections and diffraction from the exterior surface and to provide low pass filtering of an output of the transducer.

2. The loudspeaker transducer according to claim 1, wherein said optimized acoustical foam is a polyether urethane material.

3. The loudspeaker transducer according to claim 2, wherein said optimized acoustical foam has an optional skinned top surface and a skinned bottom surface.

4. The loudspeaker transducer according to claim 2, wherein said optimized acoustical foam has a nominal density of approximately 2 $lb/ft^3$.

5. The loudspeaker transducer according to claim 2, wherein said optimized acoustical foam has a thickness in the range of 6.4 mm to 25.4 mm.

6. A loudspeaker comprising:

a first transducer having a first operating frequency range disposed in a loudspeaker enclosure;

a second transducer having a second operating frequency range and a diaphragm having an exterior surface on a side of the second transducer facing away from an interior of the loudspeaker enclosure; and an optimized acoustical foam layer attached to said exterior surface of the second transducer which is so constructed as to absorb external acoustic energy and minimize acoustic reflections and diffraction off of the diaphragm of the second transducer and to provide low pass filtering of an output of the second transducer.

7. The loudspeaker according to claim 6, wherein said acoustical foam layer provides means for absorbing all frequencies within said first operating frequency range.

8. The loudspeaker according to claim 7, wherein said first operating frequency range is higher than said second operating frequency range.

9. The loudspeaker according to claim 6, wherein said optimized acoustical foam is a polyether urethane material.

10. The loudspeaker according to claim 6, wherein said optimized acoustical foam has an optional skinned top surface and a skinned bottom surface.

11. The loudspeaker according to claim 6, wherein said optimized acoustical foam has a nominal density of approximately 2 $lb/ft^3$.

12. The loudspeaker according to claim 6, wherein said optimized acoustical foam has a thickness in the range of 6.4 mm to 25.4 mm.

13. The loudspeaker according to claim 6, wherein said first transducer is a tweeter, and said second transducer is a midrange, woofer, or subwoofer.

14. A loudspeaker transducer, comprising:

a diaphragm having an exterior surface on a front side of the diaphragm facing a listening environment;

a layer of optimized acoustical foam attached to said exterior surface providing means for absorbing external acoustic energy and minimizing acoustic reflections and diffraction from the exterior surface and for low pass filtering of an output of the transducer, said layer of optimized acoustical foam having a generally uniform thickness and conforming to the shape of the diaphragm.

15. A loudspeaker comprising:

a first transducer having a first operating frequency range disposed in a loudspeaker enclosure;

a second transducer having a second operating frequency range and a diaphragm having an exterior surface on a side of the second transducer facing away from an interior of the loudspeaker enclosure; and an optimized acoustical foam layer attached to said exterior surface of the second transducer which is so constructed as to absorb substantially all frequencies within said first operating frequency range.

* * * * *